US006435890B2

(12) United States Patent
Kato et al.

(10) Patent No.: US 6,435,890 B2
(45) Date of Patent: Aug. 20, 2002

(54) MOVABLE STRUCTURE FOR CONNECTORS

(75) Inventors: Katsutoshi Kato; Kensaku Takata, both of Nagoya (JP)

(73) Assignees: Autonetworks Technologies, Ltd., Nagoya; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/824,758

(22) Filed: Apr. 4, 2001

(30) Foreign Application Priority Data

Apr. 6, 2000 (JP) ..... 2000-104394

(51) Int. Cl.[7] ..... H01R 13/64
(52) U.S. Cl. ..... 439/247; 439/544
(58) Field of Search ..... 439/247, 248, 439/557, 559, 544

(56) References Cited

U.S. PATENT DOCUMENTS 3,753,212 A * 8/1973 Yamada et al. ..... 439/247
4,992,054 A * 2/1991 Cassan ..... 439/247
5,199,900 A * 4/1993 Hayes, Sr. ..... 439/557
5,514,000 A * 5/1996 Krause et al. ..... 439/248
5,921,791 A * 7/1999 Ono et al. ..... 439/347
5,980,291 A * 11/1999 Ono ..... 439/247

FOREIGN PATENT DOCUMENTS

| | | |
|---|---|---|
| EP | 0 797 274 A | 9/1997 |
| EP | 0 840 402 A | 5/1998 |
| EP | 0 961 362 A | 12/1999 |
| JP | 10-21992 A | 1/1998 |
| JP | 10-134900 A | 5/1998 |

* cited by examiner

*Primary Examiner*—P. Austin Bradley
*Assistant Examiner*—Briggitte Hammond
(74) *Attorney, Agent, or Firm*—Oliff & Berridge, PLC

(57) ABSTRACT

A connecting portion for elastically connecting a receiving member to a stationary member is formed in such a manner as to be integral with the receiving portion. The connection portion is attached to the stationary member through the stationary portion. This stationary portion is surrounded by the receiving member across a gap SR. There is no frame serving as a stationary member around the receiving member. Thus, the movable structure becomes thin as a whole.

10 Claims, 8 Drawing Sheets

MOVABLE STRUCTURE FOR CONNECTORS

BACKGROUND OF THE INVENTION

1. Field of the Invention

The present invention relates to a movable structure for connectors

2. Description of the Related Art

Generally, a connector is used for electrical connection between electrical units (for example, electrical connection between a body of a vehicle and an instrument panel). For instance, when there are two units to be interconnected, a connector is provided on each of these units. Then, these units are electrically connected to each other by connecting these connectors together.

As the connectors, hitherto, there have been proposed various kinds of connectors having a movable structure in which one of a pair of connectors to be connected to each other is ordinarily connected to a corresponding unit and in which the other connector is attached to a unit opposed to the former unit so that the latter connector can be displaced in a direction perpendicular to a direction along which the connectors are connected to each other.

For example, in the case of connectors which the applicants of the present application have previously proposed (see JP-A-10-134900), as illustrated in FIG. 8B, in a connector fixed to a counterpart connector in a state in which the former connector is fixed to a stationary member, a connector housing 11 connected to the counterpart connector, a stationary portion 200 to be connected to the stationary member, and a connecting member for connecting the connector housing 11 to the stationary portion 200 are integrally formed by using an elastically deformable material. Moreover, the connecting portion 201 is formed into a shape adapted to have a first flexible portion 202 extending in a first direction nearly perpendicular to a direction, in which this connector is connected to the counterpart connector, and also have a second flexible portion extending in a second direction nearly perpendicular to both the direction, in which the connector is connected to the counterpart connector, and the first direction.

However, in the case of the aforementioned connectors, the stationary portion 200 supports the connector housing 11 in a state in which the stationary portion 200 covers the entire circumference of the connector housing 11. It is, thus, necessary to form a gap S between the stationary portion 200 and the connector housing 11 to thereby cause relative displacement therebetween. There is also a necessity for securing the thickness of the stationary portion 200. Consequently, the stationary portion 200 formed around the gap S becomes considerable large in size. Moreover, the connectors each have a thick two-layer structure containing the stationary portion 200 and the connector housing 11.

SUMMARY OF THE INVENTION

The present invention is accomplished in view of the aforementioned drawbacks. Accordingly, an object of the invention is to reduce the size of the stationary portion and to provide a movable structure for the connector, which is thin as a whole.

According to the invention, there is provided a movable structure for connectors, which comprises a receiving member including at least a connector, a stationary portion for fixing the receiving member to a stationary member, and a connecting portion for connecting both the receiving member and the stationary portion, the receiving member, the stationary portion, and the connecting portion being integrally formed from a elastically deformable material, wherein the stationary portion is surrounded by the receiving member in a state in which a gap for allowing relative displacement between the stationary portion and the receiving member is provided therebetween.

According to the invention, the stationary portion is surrounded by the receiving member in a state in which the stationary portion is spaced from the receiving member through a gap for allowing the relative displacement therebetween. Thus, there is no stationary portion around an outer circumferential portion of the receiving member. This eliminates the need for the gap provided in the conventional connector. Therefore, the size of the stationary portion is reduced. Moreover, a thinner structure can be realized. Moreover, this enables the reduction in the weight of the entire connector. Furthermore, the material cost thereof can be decreased. In the connector of this invention, the "receiving member" may be a connector housing itself. Alternatively, the receiving member may be a holder to be used for a predetermined object (for example, for obtaining a low inserting force structure).

Preferably, the connecting portion comprises a first flexible portion extending in a first direction nearly orthogonal to a connecting direction, in which a connector is connected to a counterpart connector, and also comprises a second flexible portion extending in a second direction nearly orthogonal to both the connecting direction and the first direction.

In the invention, the first flexible portion can perform bending deformation in a direction orthogonal to the second direction. The second flexible portion can perform bending deformation in a direction orthogonal to the second direction. Thus, the receiving portion can perform relative displacement with respect to the stationary member in the bending directions.

Preferably, the receiving member comprises a projection portion adapted to slide in a point contact with the stationary member during the alignment.

In this invention, when the alignment is performed, the receiving member slides in a point contact with the stationary portion.

Preferably, the receiving member comprises connecting force amplifying means for amplifying connecting forces of both the connectors when the former connector and the counterpart connector are connected to each other.

In the case of this structure, the connector attached to the receiving member is connector to the counterpart connector in a state in which the alignment can be performed. Moreover, the connecting forces of both the connectors are amplified.

Preferably, the movable structure further comprises an elastic member, provided in one of the receiving member and the stationary portion, for elastically attaching the receiving member to the stationary portion in cooperation with the stationary portion in such a way as to enable the receiving member to be displaced in the connector connecting direction.

In the invention, the stationary portion and the elastic member elastically attach the receiving member to the stationary member. Thus, in addition to the elastic displacement of the receiving member by the connecting portion, the displacement caused by the bending deformation of this elastic member in the direction of the connector connecting direction can be performed during the alignment.

Preferably, the elastic member is provided in a spacer for causing the receiving ember and the stationary member to float.

In the invention, even when the elastic member is fully compressed during the alignment of the receiving member, the spacer maintains a state in which the receiving member floats with respect to the stationary member. Thus, the displacement of the receiving member can be performed without regulating the receiving member by the stationary member.

Furthermore, preferably, the stationary member comprises a projection-like elastic clamp adapted to penetrate the stationary member to thereby be engaged on a penetrated-side surface thereof.

In the invention, the elastic clamp is engaged with the stationary member only by causing the stationary portion to penetrate through the stationary member. Moreover, the receiving member is attached to the stationary member in a state in which the alignment of the receiving member can be performed.

Further, the receiving member comprises a displacement regulating portion for regulating displacement of the connecting portion in a direction parallel to the connecting direction parallel to the connecting direction.

Thus, when the connector is connected to the counterpart connector, the large displacement of the receiving member in a direction parallel to the connecting direction, that is, the large deformation of the connecting portion in this direction is prevented from occurring owing to the load imposed thereto. Consequently, the connecting portion is prevented from being damaged owing to this. Additionally, this displacement regulating portion can perform displacement together with the receiving member as one unit. This eliminates the necessity for providing a space between the displacement regulating portion and the receiving member. This contributes the miniaturized structure. That is, in the case that the relative displacement between the displacement regulating portion and the receiving member is caused, similarly as in the conventional connector, there is the need for the gap allowing the relative displacement therebetween. However, the necessity for causing the relative displacement between the displacement regulating portion and the receiving member is eliminated by forming the displacement regulating portion and the receiving member in such a manner as to be integral with each other. Moreover, the stationary portion is constituted by the projection-like member. Consequently, the thickness and size of the entire structure can be reduced.

Further, preferably, the stationary portion comprises an inclination regulating portion for regulating inclination of a base portion.

Thus, even when the stationary portion is shaped like a projection, there is no fear that the connecting portion between the stationary portion and the connecting portion is damaged. Consequently, the stationary portion can be shaped into a form having a section, the area of which is reduced as much as possible. Thus, the size of the structure can be decreased still more.

Furthermore, in a practical, the receiving member may be a holder to which a plurality of connectors are attached.

Additionally, preferably, the stationary portion comprises a protection plate for protecting the elastic clamp.

DETAILED DESCRIPTION OF THE PRESENT INVENTION

Hereinafter, the invention will be described in detail with reference to the accompanying drawings.

Figure 1:
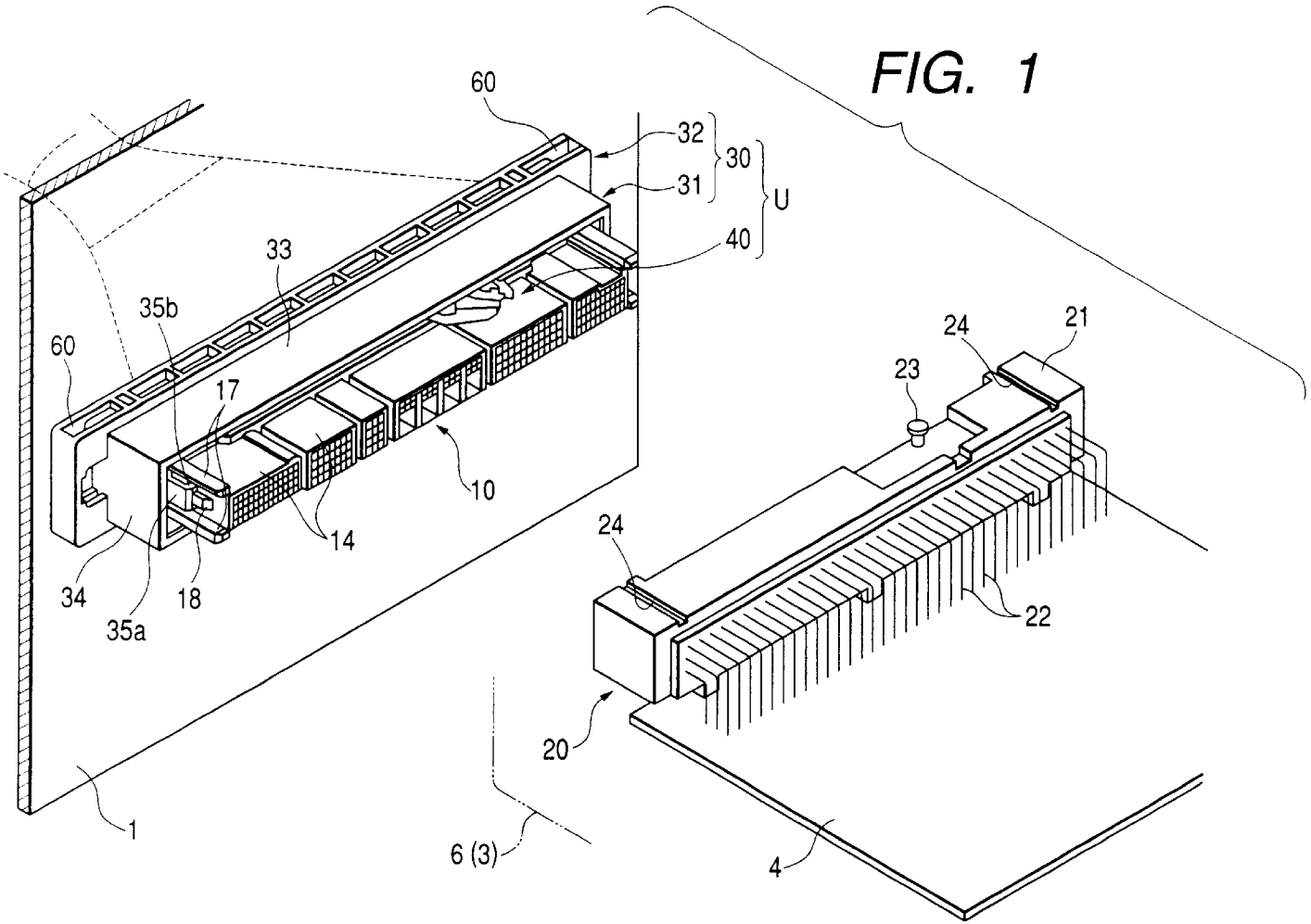
FIG. 1 is a perspective view illustrating an embodiment of a connecting structure for connectors according to the invention.

FIG. 1 is a perspective view illustrating an embodiment of a connecting structure for connectors according to the invention.

The illustrated connecting structure basically has a pair of connectors 10, 20, a holder 30 serving as a receiving member attached to a panel 1, which is constituted by a stay member of an automobile, for supporting one (hereunder referred to a holder-side connector 10) of the connectors in such a manner as to be able to slide, and a rocking lever 40 composing a primary part of a connecting force amplifying means, placed between the holder 30 and the holder-side connector 10, for amplifying the connecting forces of the connectors 10 and 20.

In the illustrated example, the holder-side connector 10 is an assembled connector into which connecting primary parts, for example, a floor harness, a door harness, a signal harness, an audio/visual harness, a navigation harness, an instrument panel harness (that is, a main harness including a main ECU (Electronic Control Unit) and a power supply circuit) of an automobile are assembled. Such kinds of harnesses are manufactured in different harness factories, respectively. Then, such harnesses are tied and assembled into integral harnesses in an assembly factory.

The holder-side connector 10 has a male housing block 14, which is slidably inserted into the holder 30, and a plurality of female terminals disposed in terminal accommodating chambers of the housing block 14.

Further, pairs of upper and lower ribs 17 are provided on both the lateral side surfaces of the housing block 14 so as to guide the connector. Moreover, a temporary fixing portion 18 provided thereon so as to prevent the holder-side connector 10 by temporally fixing the holder-side connector 10 at the connection standby position from being inserted into the holder 30 before a connecting operation is performed.

The other connector 20 (hereunder referred to as a counterpart connector) is a block connector mounted on a circuit board 4 of, for example, an electronic module unit 3 (for instance, center cluster module) of an instrument panel.

This counterpart connector 20 has a female housing block 21, which is fitted to the outside of and engaged with the housing block 14 of the holder-side connector 10, and a plurality of male terminals disposed in terminal chambers of the housing block 21. Further, the housing block 21 is fixed to the circuit board 4 by means, such as screws. Moreover, a connecting portion 22 of the male terminal is drawn out of the rear end portion of the housing block 21 and connected to the conductive portion of the circuit board 4 by soldering. The counterpart connector 20 and the circuit board 4 are accommodated in a case 6 of the electronic module unit 3. Furthermore, a driven pin 23 to be driven by the rocking lever 40 is provided on each of the top wall portion and the bottom wall portion of the housing block 21 therefrom.

A procedure for connecting both the connectors 10 and 20 is similar in principle to that described in the foregoing description of the conventional structure (regarding the detail of the procedure, see JP-A-10-21992). Thus, the detail description thereof is omitted herein.

The holder 30 is a resin molding that has a body frame portion 31, which is formed like a rectangular frame as a whole, and a flange portion 32 formed on the outer circumference of an opening portion at one end side of the body frame portion 31.

Figure 2:
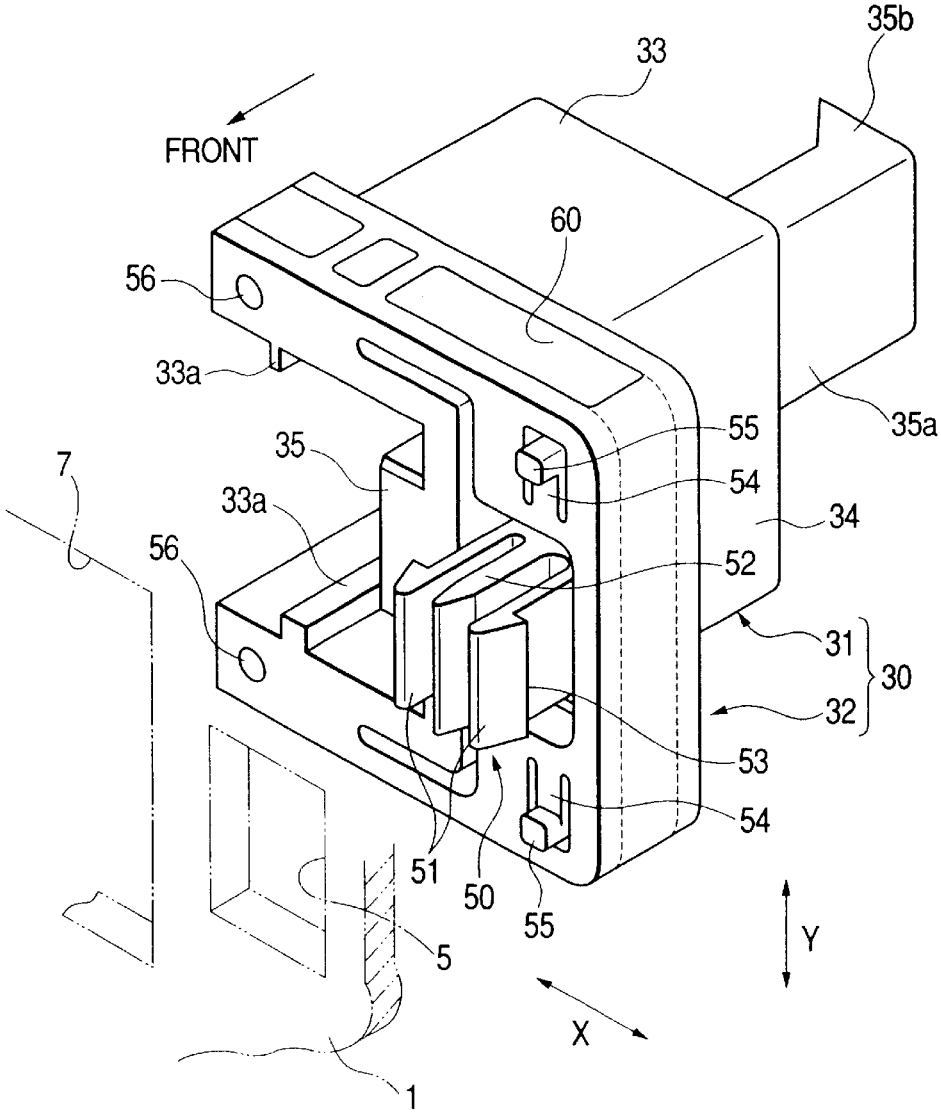
FIG. 2 is an enlarged perspective view illustrating a primary part of a holder according to the embodiment of FIG. 1.
Figure 3:
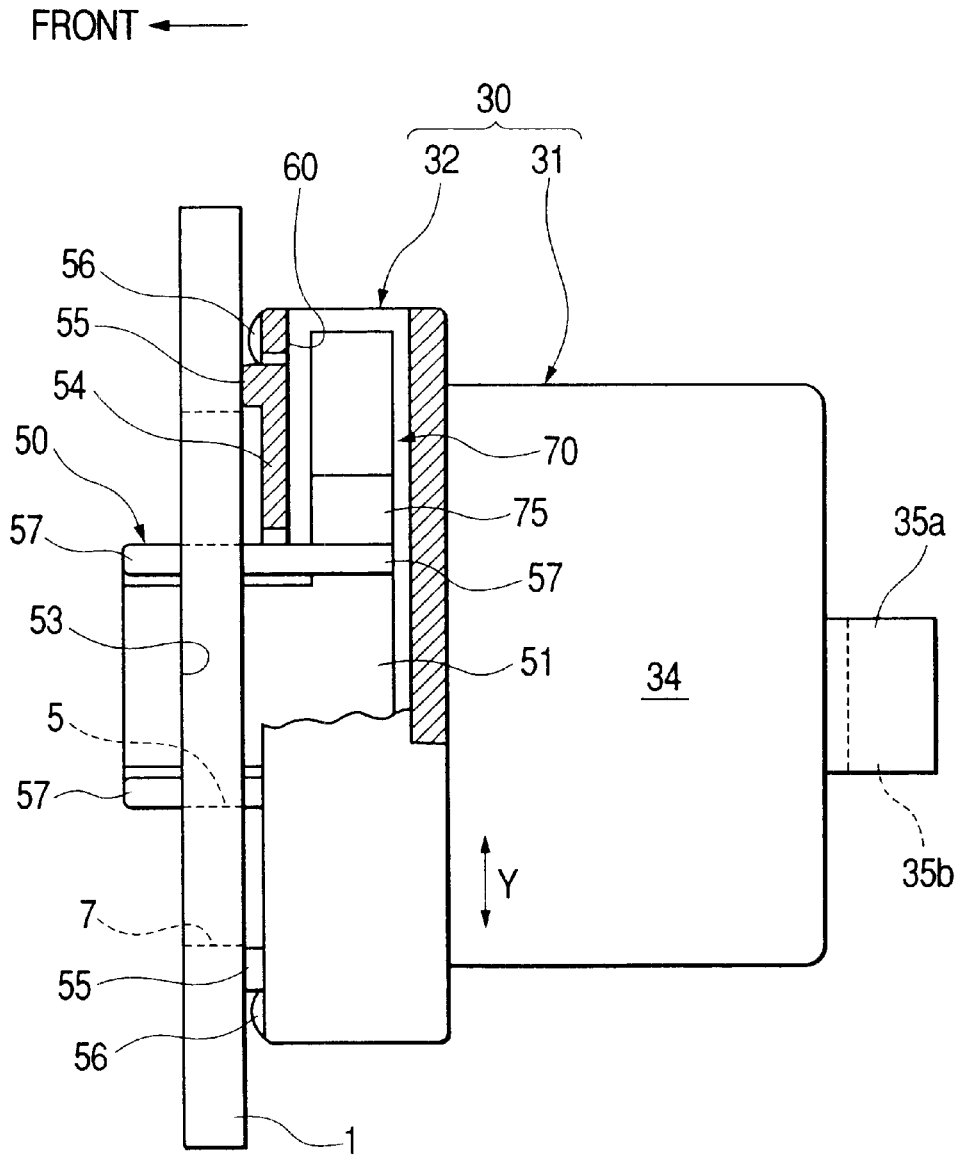
FIG. 3 is a side view illustrating the holder of the embodiment of FIG. 1.
Figure 4:
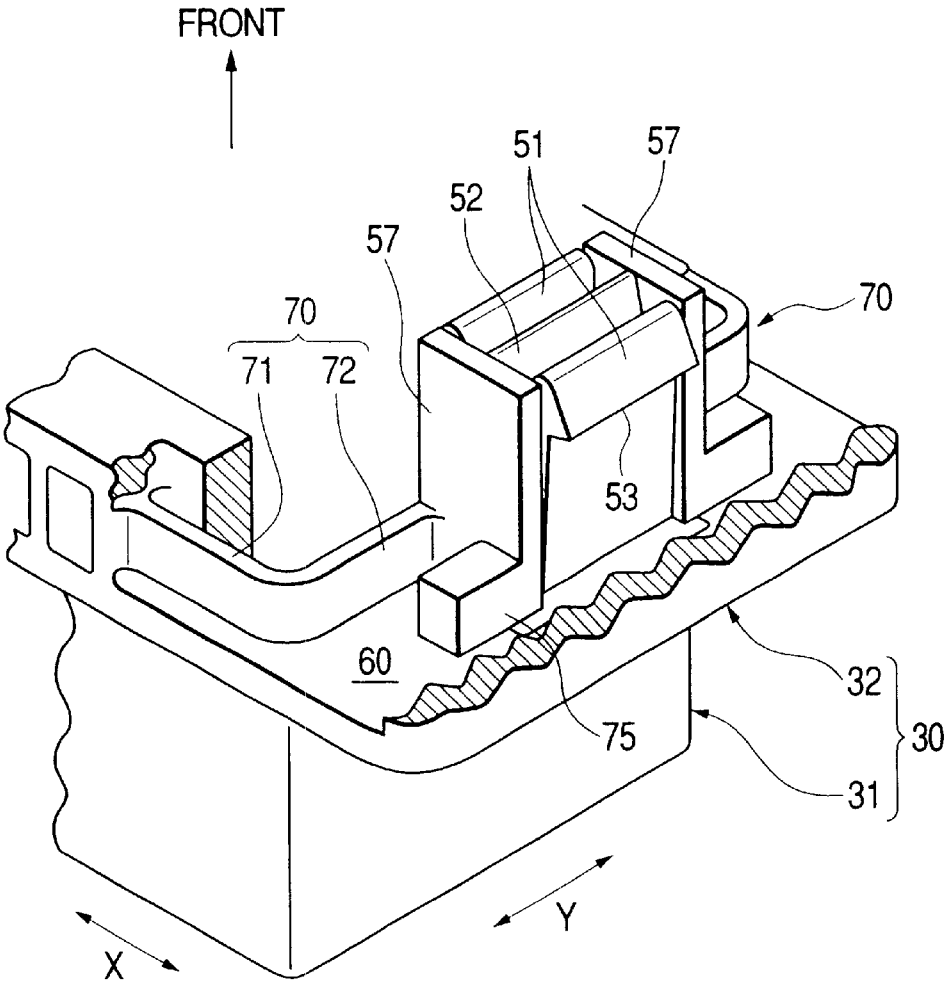
FIG. 4 is a partially cut away view illustrating the primary part of the holder of the embodiment of FIG. 1.

FIG. 2 is an enlarged perspective view illustrating a primary portion of the holder 30 according to the embodiment of FIG. 1. FIG. 3 is a side view illustrating the holder 30. FIG. 4 is a partly cutaway perspective view illustrating a primary portion of the holder 30 of the embodiment of FIG. 1. Incidentally, in the following description, it is assumed that the side, on which the flange portion 32 is formed, of the holder 30 is the front side of the embodiment.

As illustrated in these figures, the body frame portion 31 is basically used for accommodating the holder-side connector 10 in such a way as to enable the displacement of the connector 10 by sliding. The body frame portion 31 has a pair of upper and lower horizontal wall portions 33 and a pair of lateral wall portions 34, which are integrally provided with one another. Further, a rib 35 serving as an attaching portion for slidably attaching the holder-side connector 10 is formed on each of the inner wall surfaces of both the lateral side wall portions 34 in such a way as to extend horizontally. In the illustrated embodiment, a temporarily holding arm 35*a* is formed at the rear end portion of the rib 35 so that a rear end side portion of the arm is freely rockable. A catching projection 35*b* for temporarily holding the temporarily fixing portion 18 of the holder-side connector 10 is formed at a free end of the arm 35*a* (see FIG. 1). The engagement of the temporarily fixing portion 18 with the rear end surface of this catching projection 35*b* enables the holder-side connector 10 to be tentatively fixed at the connection standby position (see FIG. 1) at which the connector 10 is ready for being connected to the counterpart connector 20. A rib 33*a* is formed on the inner surface of the horizontal wall portion 33. This rib 33*a* corresponds to a groove 24, formed in the housing block 21 of the counterpart connector 20, in such a way as to be able to be fitted thereinto. This rib 33*a* and the groove 24 determine the positions of both the connectors 10 and 20 when connected to each other.

Further, the flange portion 32 is formed so that a pair of catching projections 50 (projection-like members) corresponding to a pair of lateral mounting holes 5 formed in the panel 1 is frontwardly protruded therefrom. This embodiment is configured so that the holder-side connector 10 is attachably fixed in the holder 30 through an insertion hole 7, which is formed between the mounting holes 5, by fitting this catching projection 50 into the mounting holes 5.

In the illustrated embodiment, an opening portion 60, which has a nearly U-shaped horizontal section (see FIGS. 5A and 5B) and penetrates through the flange portion 32 in a direction of a larger thickness thereof is formed at each of four corner parts of both the side walls of the flange portion 32. The catching projection 50 is erected in the central portion in the frontward and backward directions of each of the opening portions 60. Incidentally, in FIG. 4, reference character 60*a* designates a drawing hole formed when the catching projections 50 are formed.

As illustrated in FIG. 2, the catching projection 50 constitutes the stationary portions of the illustrated embodiment. The projection 50 is provided by forming a pair of elastic clamps 51, which are opposed to each other in a direction of width and a plate portion 52 erected between the elastic clamps 51, with each other in such a way as to be integral with each other at the rear end portion thereof and as to be frontwardly projected therefrom Each of the elastic clamps 51 has a catching portion 53 whose horizontal section is formed like an arrowhead. This catching portion 53 elastically penetrates through the through hole 5 and is engaged with the front of the panel 1. Thus, the holder 30 is attached to the panel 1 through the catching projection 50.

Incidentally, as illustrated in FIGS. 2 and 3, a pair of cantilevers 54 is disposed in front of the flange portion 32 in such a manner as to catch the catching projections 50 at the upper and lower positions. A pushing projection 55 is provided in such a manner as to be frontwardly projected from the free end of each of the cantilevers 54. Further, the pushing projections 55 elastically pinch the panel 1 between the catching portions 53 of the catching projections 50. Thus, the catching projections 50 (therefore, the holder 30) attached to the panel 1 in such a manner as to be elastically displaced in the frontward and backward directions by an amount of deformation of the cantilevers 54. Furthermore, nib-like projections 56 are provided in front of the flange portion 32 in such a way as to project therefrom. When the displacement thereof is caused by the cantilevers 54, the holder 30 is in contact with the panel 1 in a point contact state by the nib-like projections 56, so that the sliding resistance at the time of an occurrence of the displacement.

Referring next to FIG. 4, there is shown the catching projection 50 that has a pair of protection plates 57, 57 (omitted in FIG. 2) disposed in such a way as to face each other in a direction orthogonal to a direction in which the elastic clamps 51, 51 face each other. The clamps 51 and the plate portion 52 are placed in a state in which the clamps 51 and the plate portion 52 are put between these protection plates 57 and 57. Moreover, the protection plates 57, 57, the elastic clamps 51 and the plate portion 52 are formed in such a manner as to be integral with one another at a base portion. Furthermore, each of the protection plates 57 and 57 is formed in such a way as to be integral with the flange portion 32 of the holder 30 through a corresponding connecting arm 70 serving as the connecting portion.

In the opening portion 60, each of the connecting arms 70 has thin first flexible portions 71, which outwardly longitudinally extend in the direction of the X-axis from both X-axis portions 32*b* and, and a second flexible portion 72 that extends in the direction of the Y-axis horizontally orthogonal to the X-axis from an end of this first flexible portion 71 and that is integral with the first flexible portions 71. Each of the connecting arm 70 is shaped like a letter "L" extending along the contour of the shape of a horizontal section of the opening portion 60 (see FIGS. 5A and 5B) Further, the first flexible portion 71 is formed in such a way as to be integral with the flange portion 32. The second flexible portion 72 is formed in such a manner as to be integral with the protection plate 57. Thus, the holder 30 is connected to the catching projection 50 in such a way as to be able to be displaced in the directions of the X-axis and the Y-axis. This provides a receiving structure in which the holder-side connector 10 to be attached to the holder 30 by displacement thereof can be aligned with the counterpart connector 20.

Incidentally, it may be that the second flexible portion 72 and the first flexible portion 71 do not extend in a direction completely parallel to the directions of the X-axis and the Y-axis, and that the flexible portions 71 and 72 are slightly inclined to the directions of the X-axis and the Y-axis, respectively.

Incidentally, in the illustrated embodiment, the first flexible portion 71 is connected to both side portions from the side surfaces of the flange portion 32 in the direction of the X-axis in a state in which the portion 71 is inserted into the opening portion 60. Further, the second flexible portion 72 connects the first flexible portion 71 to the protection plate 57 in the opening portion 60. Moreover, the connecting arm 70 is adapted to be able to be displaced by an inner wall portion of the opening portion 60 in a direction (that is, in the frontward and backward directions of the holder 30), in which the connectors are fitted to each other, by a predetermined stroke. In other words, this opening portion 60 constitutes the regulating means for regulating the displacement in the direction, in which the connectors are connected to each other, of the connecting arm 70 in such a way as to be within a predetermined range.

Moreover, as illustrated in FIG. 4, a pair of inclination regulating ribs 75 is formed on both sides of the catching projection 50 in each of the protection plates 57. Each of the inclination regulating ribs 75 is operative to restrain a corresponding one of the catching projections 50 from excessively being inclined in the direction of the Y-axis around an axis extending in the frontward and backward directions of the holder 30. This prevents the base portion of each of the catching projections 50 from excessively being inclined and damaged when the catching projections 50 are rocked by the first flexible portions 71 of the connecting arm 70.

Figure 5A:
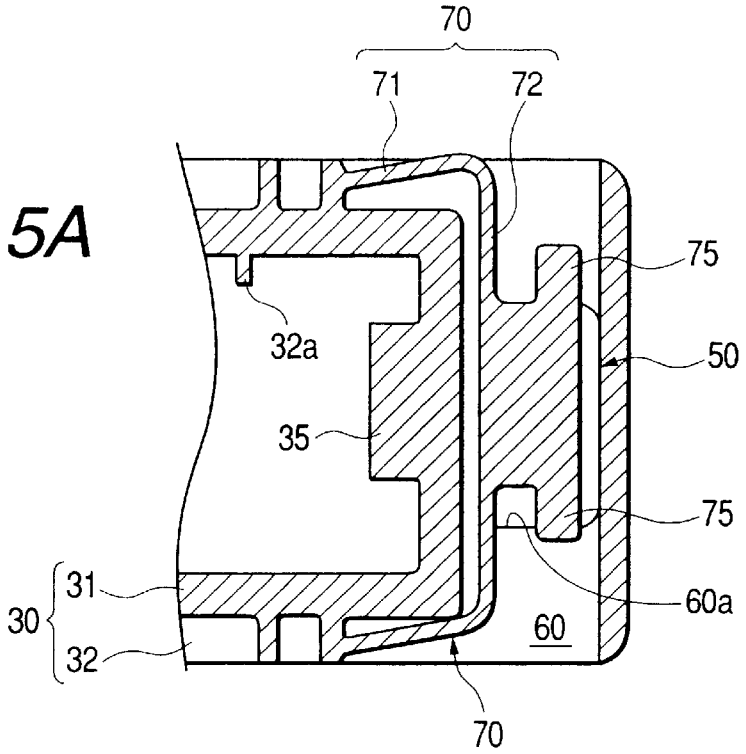
FIGS. 5A and 5B are schematic partially sectional plan views illustrating the first embodiment of FIG. 1.
Figure 5B:
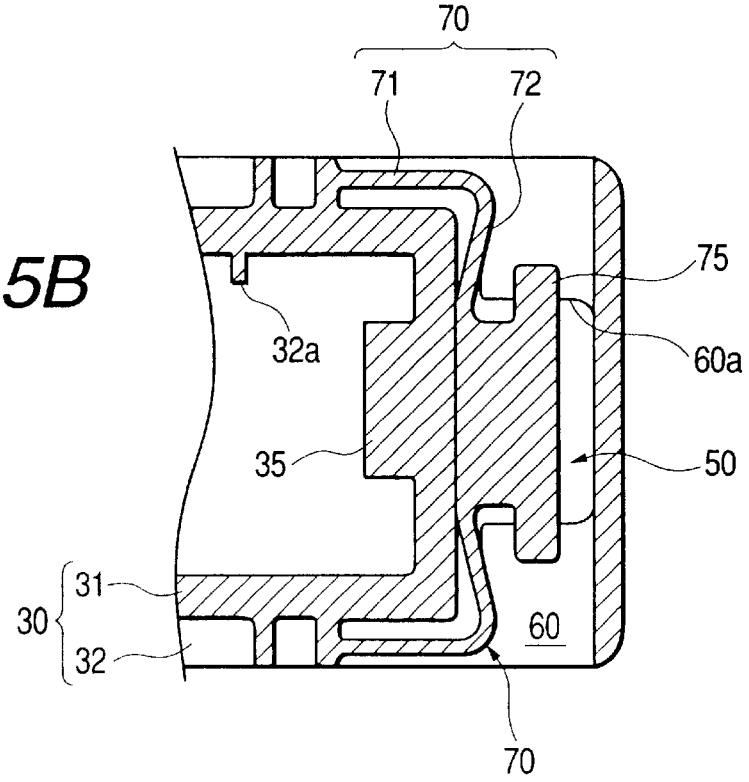

FIGS. 5A and 5B are schematic partially sectional plan views illustrating the embodiment of FIG. 1.

In this embodiment, when the first flexible portion 71 bends in the direction of the Y-axis as illustrated in FIG. 5A, the relative displacement of the holder 30 can be performed in the direction of the Y-axis with respect to the catching projections 50 (that is, with respect to the panel 1). Further, when the second flexible portion 72 bends in the direction of the X-axis as illustrated in FIG. 5B, the relative displacement of the holder 30 can be performed with respect to the catching projections 50 (that is, with respect to the panel 1). That is, the bending deformation of the entire connecting arm 70 enables the free and relative displacement of the holder 30 in the directions of the X-axis and the Y-axis. Therefore, even when there is an error in a place on the panel 1, to which each of the catching projections 50 is fixed, the error can be absorbed by the displacement of the holder 30. Consequently, an operation of connecting both the connectors 10 and 20 to each other can be smoothly performed.

Further, the displacement of the holder 30 in the direction, in which the connectors are connected to each other, with respect to the catching projections 50 is regulated by the regulating ribs 75 provided on the protection plates 57. This prevents large displacement in the direction, in which the connectors are connected to each other, of the holder 30, that is, large displacement of each of the connecting arms 70 in the same direction from occurring due to a load imposed thereto when the terminals of the connectors are fitted to each other. Furthermore, this embodiment can have an advantage in that the connecting arms 70 can be prevented from being damaged owing to this deformation.

Figure 8A:
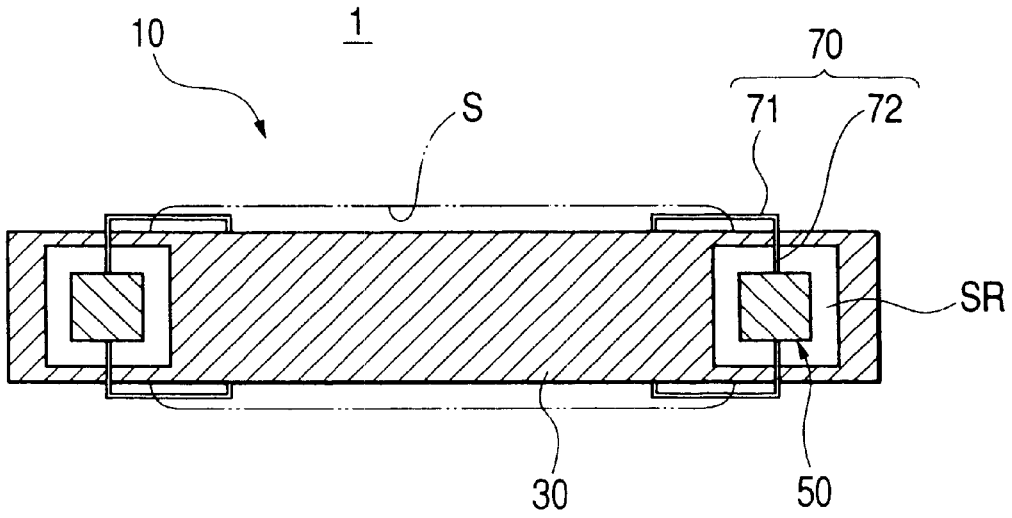
FIG. 8A is a schematic sectional view illustrating the embodiment of the invention.
Figure 8B:
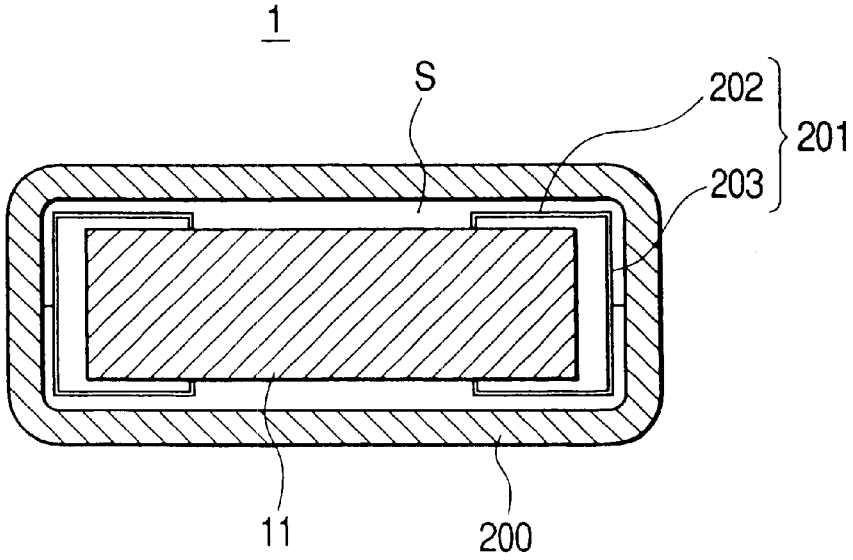
FIG. 8B PRIOR ART
FIG. 8B is a schematic sectional view illustrating a conventional connector.

FIGS. 8A and 8B are schematic views for making comparison in configuration between the connector according to this embodiment and the conventional connector. Further, FIG. 8A is a schematic sectional view illustrating this embodiment. Moreover, FIG. 8B is a schematic sectional view illustrating the conventional connector.

As schematically illustrated in FIGS. 8A and 8B, the catching projections 50 are surrounded by the holder 30 through a gap SR for permitting the relative displacement thereof with respect to the holder 30. Thus, no stationary portion is provided in an outer peripheral portion of the holder 30. This eliminates the necessity for forming the gap S (that is, a portion indicated by in FIG. 8A) similarly as formed in the conventional connector. Consequently, the size of the stationary portion (thus, the catching projections 50) can be reduced. Moreover, a thinner structure can be realized. Furthermore, the weight of the entire connector can be reduced. Additionally, the material cost thereof can be decreased.

As described above, according to this embodiment, there is no stationary portion, such as a frame, around the peripheral portion of the holder 30. Moreover, the gap as provided in the conventional connector is not formed in the embodiment of the invention. Therefore, the size of the stationary portion is decreased. A thinner structure can be realized. Furthermore, the weight of the entire connector is reduced. Moreover, the material cost thereof can be decreased.

Furthermore, in the aforementioned embodiment, the holder-side connector 10 attached to the panel 1 through the holder 30 is connected to the counterpart connector 20. When connected to each other, the connecting forces of both the connectors 10 and 20 are amplified by the connecting force amplifying means (such as the rocking lever 40) provided in the holder 30. At that time, in this embodiment, the connecting arms 70 for elastically connecting the holder 30 to the panel 1 are formed in such a way as to be integral with the holder 30. The connecting arms 70 are formed and shaped in such a way as to have the first flexing portion 71 extending in a first direction nearly orthogonal to a direction (that is, the direction of the X-axis in the case of the illustrated example), in which the connectors are connected to each other, and also have the second flexing portion 72 extending in a second direction (that is, the direction of the Y-axis in the case of the illustrated example) nearly orthogonal to both the direction, in which the connector 10 and the counter connector 20 are connected to each other, and first direction. Thus, as illustrated in FIGS. 5A and 5B, the first flexible portion 71 and the second flexible portion 72 can perform bending deformation in the direction of the Y-axis and the direction of the X-axis, respectively. The relative displacement of the holder 30 with respect to the panel 1 can be performed in the bending directions. Therefore, in this mode, the connector attached to the holder 30 is connected to the counterpart connector 20 in a state in which the former connector can be aligned with the panel 1 through the holder 30. Moreover, the connecting forces of both the connectors 10 and 20 are amplified.

Especially, in the aforementioned embodiment, the holder 30 has the nib-like projections 56 serving as a projection portion, which is operative to slide in a point contact with the panel 1 during the alignment thereof. Thus, the holder 30 is caused by the nib-like projections 56 to slide in a point contact with the panel 1 during the alignment. As compared with the case that the holder 30 has a face-like portion, which is subject to the sliding resistance, the displacement of the holder 30 can be smoothly performed.

Further, in the illustrated embodiment, each of the connecting arms 70 has the catching projection 50 (that is, the projection-like stationary portion) adapted to penetrate through the panel 1 to thereby fix the holder 30 to the panel 1. Thus, the fixing structure of the holder 30 to the panel 1 is reduced as much as possible. Consequently, a more compact structure can be realized.

Moreover, the illustrated embodiment has the cantilevers 54 serving as elastic members for elastically attaching the holder 30 to the panel 1 by operating in cooperation with the catching projections 50 so that the displacement of the holder 30 in the direction, in which the connectors are connected to each other, can be achieved. Thus, the catching projection 50 and the cantilevers 54 elastically connect the holder 30 to the panel 1. Consequently, not only the elastic displacement of the holder 30 by the connecting arms 70 but the displacement thereof in the direction, in which the connectors are connected to each other, owing to the bending of the cantilevers 54 can be achieved during the alignment thereof.

Furthermore, the catching projection 50 has the catching portions 53 (that is, the elastic clamps) adapted to penetrate through the panel 1 thereby to be engaged on the surface at the penetrated side. Thus, the elastic clamps of the catching projections 50 can be engaged with the panel 1 and the holder 30 can be attached to the panel 1 in a state, in which the alignment of the holder 30 with the panel 1 can be performed, only by causing the catching projection 50 to penetrate through the panel 1.

Therefore, an attaching operation is considerably facilitated.

Furthermore, the catching projection 50 has the opening portion 60 serving as the displacement regulating portion for regulating the displacement of the holder 30 in a direction parallel to the direction in which the connector 10 and the counter connector 20 are connected to each other. Thus, the large displacement of the holder 30 in the direction parallel to the direction, in which the connectors are connected to each other, that is, the large displacement of the connecting arms 70 in such a direction is prevented from being caused owing to the load imposed onto the holder 30 at the time of the connection between the connector 10 and the counterpart connector 20.

Especially, the opening portion 60 is formed in the flange portion 32 of the holder 30. Thus, the displacement of the opening portion 60 together with the holder 30 can be performed. This eliminates the necessity for providing the gap between the opening portion 60 and the holder 30. The size of the connector can be reduced still more for that. That is, in the case that the connector employs the configuration in which the relative displacement of the displacement regulating portion (the portions corresponding to the opening portion 60) with respect to the holder 30 is performed, similarly as in the case of the conventional connector, the gap for allowing the relative displacement therebetween is needed. However, both of the holder 30 and the opening portion are integrally formed, so that the need for causing the relative displacement thereof is eliminated. Moreover, the stationary portion is constituted by the catching projection 50. These contribute to the reduction in the thickness and size of the entire connector.

Additionally, the catching projection 50 has the inclination regulating ribs 75 serving as the inclination regulating portion for regulating the inclination of the base portion. Thus, even when the catching projection 50 is shaped like a projection, there is no fear that the connecting portion among the projection 50 and the arms 70 is damaged. The catching projection 50 can be shaped so that the section thereof is reduced as much as possible. Moreover, the size of the connector can be decreased still more.

Incidentally, the embodiment of the invention is not limited to this. For example, the following embodiment may be made.

Figure 6:
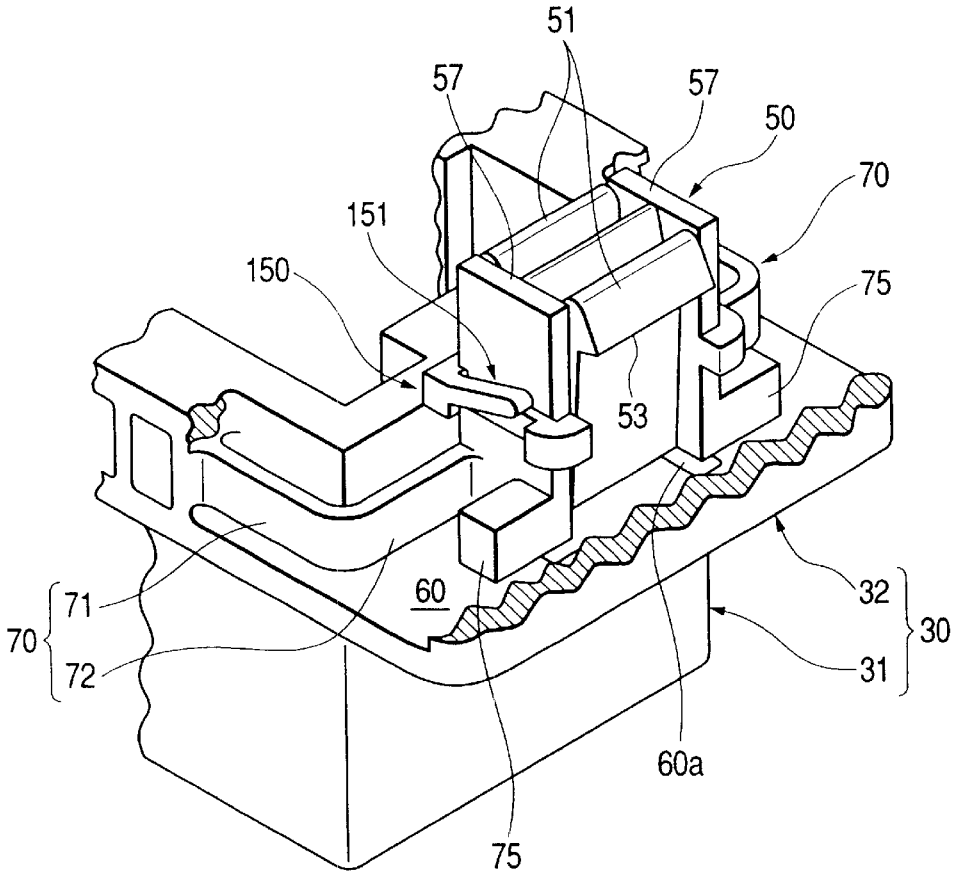
FIG. 6 is a partially cutaway perspective view illustrating a primary portion of a holder according to another embodiment of the invention.
Figure 7:
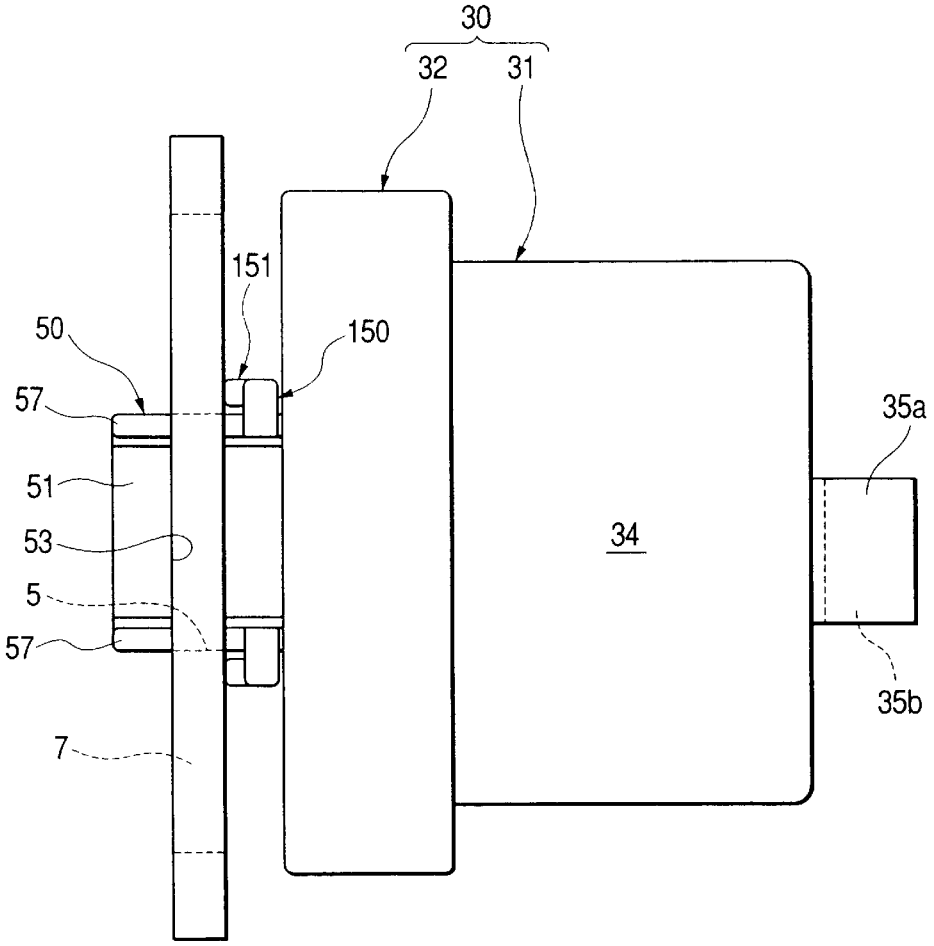
FIG. 7 is a side view illustrating an attached state of the holder according to the embodiment of FIG. 6.

FIG. 6 is a partially cutaway perspective view illustrating a primary portion of a holder 30 according to another embodiment of the invention. FIG. 7 is a side view illustrating an attached state of the holder 30 according to the embodiment of FIG. 6.

As illustrated in these figures, in the illustrated embodiment, a nearly ring-like spring seat 150 is provided on a middle portion of a catching projection 50. A cantilever-like spring 151 is formed in such a way as to be integral with this spring seat 150. Further, in the illustrated embodiment, this spring 151 operates in cooperation with the catching projection 50, which constitute an elastic member for elastically attaching the holder 30 to a panel 1.

Furthermore, in the illustrated embodiment, this spring 151 is provided on the spring seat 150 acting as a spacer for making the holder 30 and the panel 1 float. Thus, even when the spring 150 is fully compressed during the alignment of the holder 30, the state, in which the holder 30 floats with respect to the panel 1 (see FIG. 7), is maintained by the spring seat 150. This enables the holder 30 to make displacement without being regulated by the panel 1.

Therefore, in the illustrated embodiment, the smooth displacement of the holder 30 is achieved during the alignment thereof, without providing the nib-like projection 56 similarly as in the case of the embodiment first described in the foregoing description. The rest of the illustrated embodiment is similar to the first embodiment. Thus, in these figures, like reference characters designate like constituent elements of the first embodiment. Further, the description of such constituent elements is omitted.

Thus, the aforementioned embodiments are only the illustration of preferred examples of the invention. However, the present invention is not limited thereto. Obviously, various design variations are possible within the scope of the invention, which is determined by the appended claims.

As described above, the invention has outstanding effects of reducing the size of the stationary portion, and realizing a thinner structure.

What is claimed is:

1. A movable structure for connectors, comprising:

a receiving member including at least a connector;

a stationary portion for fixing the receiving member to a stationary member, the stationary portion being surrounded by the receiving member to define a gap for allowing relative displacement between the stationary portion and the receiving member; and a connecting portion for connecting the receiving member with the stationary portion, wherein the receiving member, the stationary portion, and the connecting portion are integrally formed with each other and made from elastically deformable material; and the connecting portion comprises:

a first flexible portion extending in a first direction nearly orthogonal to a connecting direction;

a second flexible portion extending in a second direction nearly orthogonal to both of the connecting direction and the first direction; and wherein the first and second portions are independently flexible.

2. The movable structure for connectors according to claim 1, wherein the receiving member comprises a projection portion adapted to slide in a point contact state with the stationary member during alignment.

3. The movable structure for connectors according to claim 1, wherein the receiving member comprises a connecting force amplifying unit for amplifying connecting forces between connected connectors.

4. The movable structure for connectors according to claim 1, further comprising an elastic member, provided in at least one of the receiving member and the stationary portion, for elastically attaching the receiving member to the stationary member in cooperation with the stationary portion to enable the receiving member to be displaced in a connector connecting direction.

5. The movable structure for connectors, according to claim 1, wherein the stationary portion comprises an inclination regulating portion for regulating inclination of a base portion of the stationary portion.

6. The movable structure for connectors according to claim 1, wherein the receiving member is a holder to which a plurality of connectors are attached.

7. The movable structure for connectors according to claim 1, wherein the receiving member comprises a displacement regulating portion for regulating displacement of the connecting portion in a direction parallel to a connecting direction.

8. The movable structure for connectors according to claim 4, wherein the elastic member is provided in a spacer for causing the receiving member and the stationary member to float.

9. The movable structure for connectors according to claim 1, wherein the stationary member comprises a projected elastic clamp adapted to cause the stationary portion to penetrate the stationary member to thereby be engaged with a surface of the stationary member.

10. The movable structure for connectors according to claim 9, wherein the stationary portion comprises a protection plate for protecting the elastic clamp.

* * * * *